US005722605A

United States Patent [19]

Finken

[11] Patent Number: 5,722,605

[45] Date of Patent: Mar. 3, 1998

[54] ROLL CRUSHER

[75] Inventor: Wolfgang Finken, Ennigerloh, Germany

[73] Assignee: Krupp Fördertechnik GmbH, Duisburg, Germany

[21] Appl. No.: 646,120

[22] Filed: May 7, 1996

[30] Foreign Application Priority Data

May 17, 1995 [DE] Germany ..... 195 18 061.5
Jun. 20, 1995 [DE] Germany ..... 195 22 251.2

[51] Int. Cl.[6] ..... B02C 4/32

[52] U.S. Cl. ..... 241/32; 241/37; 241/231

[58] Field of Search ..... 241/37, 231, 285.1, 241/32; 92/27, 28; 91/42

[56] References Cited

U.S. PATENT DOCUMENTS

| | | | |
|---|---|---|---|
| 2,588,180 | 3/1952 | Traylor | 241/231 X |
| 3,176,590 | 4/1965 | Uhtenwoldt et al. | 91/42 X |
| 3,586,138 | 6/1971 | Engle | 92/27 X |
| 3,938,732 | 2/1976 | Schrimper et al. | 241/231 |
| 3,984,151 | 10/1976 | Altmayer | 241/231 X |
| 4,074,866 | 2/1978 | Meder | 241/231 X |
| 4,140,285 | 2/1979 | Linzberger et al. | 241/37 X |
| 4,185,539 | 1/1980 | Statienko | 92/27 X |
| 4,220,288 | 9/1980 | Gatley | 241/37 |
| 4,635,861 | 1/1987 | Resch | 241/37 |
| 4,856,411 | 8/1989 | Maurer et al. | 92/28 X |
| 5,052,277 | 10/1991 | Wirth | 92/28 X |
| 5,067,660 | 11/1991 | Reinhall | 241/37 |

FOREIGN PATENT DOCUMENTS

| | | | |
|---|---|---|---|
| 0 340 464 | 11/1989 | European Pat. Off. . | |
| 88 14 247 | 3/1989 | Germany . | |
| 4-131145 | 5/1992 | Japan | 241/37 |
| 90/01371 | 2/1990 | WIPO | 241/37 |
| 90/14164 | 11/1990 | WIPO | 241/231 |

*Primary Examiner*—John M. Husar
*Attorney, Agent, or Firm*—Spencer & Frank

[57] ABSTRACT

A roll crusher includes a crusher roll; a support for rotatably and radially shiftably supporting the crusher roll; a stationarily supported countermember cooperating with the crusher roll to define a crushing gap therewith; and a hydraulic setting system for radially displacing the crusher roll for varying the crushing gap. The hydraulic setting system includes a pressure source and a piston rod executing strokes and having an end coupled to the roll support for transmitting to the crusher roll setting forces derived from the pressure source. Further, an abutment device is provided for limiting the strokes of the piston rod to set a minimum magnitude of the crushing gap. The abutment device includes an actuating mechanism for placing the abutment device into a stroke-limiting state and into a piston rod-releasing state.

10 Claims, 2 Drawing Sheets

ROLL CRUSHER

CROSS REFERENCE TO RELATED APPLICATION

This application claims the priority of German Application Nos. 195 18 061.5 filed May 17, 1995 and 195 22 251.2 filed Jun. 20, 1995, which are incorporated herein by reference.

BACKGROUND OF THE INVENTION

The invention relates to a roll crusher which may of the type that has two oppositely rotated rolls spaced from one another by an adjustable crushing gap. One of the rolls is radially adjustable (shiftable), while the other roll (countermember) is stationarily supported. The roll crusher may also be of the type which has a single, shiftable roll cooperating with a crusher plate (countermember). In either structure, the shiftable roll is connected with at least one piston rod with the intermediary of a bearing housing and is displaceable by a hydraulic system.

In roll crushers or roll mills of the above-outlined type the crushing gap between the shiftable roll and the countermember (stationary crusher roll or crusher plate) is conventionally set in such a manner that the shiftable roll is mechanically or hydraulically displaced and thereafter mechanically immobilized. Such a process is relatively complex because the support and immobilizing systems for the shiftable roll first have to be rendered accessible. Further, the gap setting requires substantial skill as well as great care; these assets cannot be assumed to necessarily characterize the operating personnel.

SUMMARY OF THE INVENTION

It is an object of the invention to provide an improved roll crusher of the above-outlined type which makes possible a simpler and operationally safer setting of the roll gap (crushing gap) and also permits a stepless remote adjustment.

This object and others to become apparent as the specification progresses, are accomplished by the invention, according to which, briefly stated, the roll crusher includes a crusher roll; a support for rotatably and radially shiftably supporting the crusher roll; a stationarily supported countermember cooperating with the crusher roll to define a crushing gap therewith; and a hydraulic setting system for radially displacing the crusher roll for varying the crushing gap. The hydraulic setting system includes a pressure source and a piston rod executing strokes and having an end coupled to the roll support for transmitting to the crusher roll setting forces derived from the pressure source. Further, an abutment device is provided for limiting the strokes of the piston rod to set a minimum magnitude of the crushing gap. The abutment device includes an actuating mechanism for placing the abutment device into a stroke-limiting state and into a piston rod-releasing state.

The invention may find application in twin-roll crushers having oppositely rotated rolls as well as single-roll crushers having only a single roll which is shiftably mounted and which cooperates with a crusher plate.

The shiftable roll is connected, with the intermediary of a bearing housing, with at least one piston rod whose stroke is limited by a preferably hydraulically regulatable abutment device. The abutment device serves not only for providing a mechanical securement based on the principle of a counternut, but also makes possible individually settable relative displacements of the piston rod which are easily reproducible and may also be remote-controlled and thus automated. The handling of the roll crusher is thereby significantly facilitated. Further, the abutment device limits the piston stroke only in one direction, that is, the abutment functions only to prevent the crusher roll from assuming a distance from the countermember which is less than the desired roll clearance while, by means of a spring support or a hydraulic support, the shiftable roll may, as before, yield in case of excessive loads.

According to an advantageous feature of the invention, a clamping head, serving as the abutment device, is releasably immobilized on the piston rod. The clamping head is an easily operable securing element. According to a further advantageous feature of the invention, the piston rod is passed through the bottom of a double acting hydraulic cylinder which is connected to the roll crusher housing on which the clamping head is countersupported. The double-acting cylinder has two work chambers chargeable with a hydraulic fluid to provide for a desired piston rod adjustment according to the crushing gap. Such a hydraulic cylinder acts as a safety device against excessive loads by permitting the piston rod to yield in case a predetermined pressure value is exceeded. In such a case, the clamping head remains in its immobilized position on the piston rod and after elimination of the excessive load conditions, the piston rod is again moved out to an extent until the clamping head abuts the hydraulic cylinder, whereby the desired crushing gap has been reestablished.

According to a further advantageous feature of the invention, the piston rod has, at one end, a head which engages the clamping head either directly or with the interposition of an additional compression spring.

According to a further feature of the invention, the maximum pressure acting on the arrested piston rod is limited by a pressure limiting valve, that is, the piston rod yields when a certain pressing force exerted on the shiftable crusher roll is exceeded.

According to another feature of the invention, one of the work chambers of the double-acting cylinder is hydraulically coupled with a pressure accumulator whose bias pressure may be adjusted for limiting the maximum crushing force.

The shiftable roll of the roll crusher may be connected with one or more piston rods. In case a plurality of piston rods are used, each piston rod is associated with separate respective hydraulic cylinder units which are coupled to one another preferably by means of a synchronous control mechanism.

It is possible in principle to provide a remote control for regulating the biasing pressure of the clamping head and/or the double-acting cylinder; such a control may be realized by a single hydraulic circuit.

By virtue of a conventional displacement measuring arrangement, the position of the shiftable roll and thus indirectly the crushing gap between the rolls may be measured, so that any desired crushing gap may be remotely set and monitored.

DESCRIPTION OF THE PREFERRED EMBODIMENT

Figure 1:
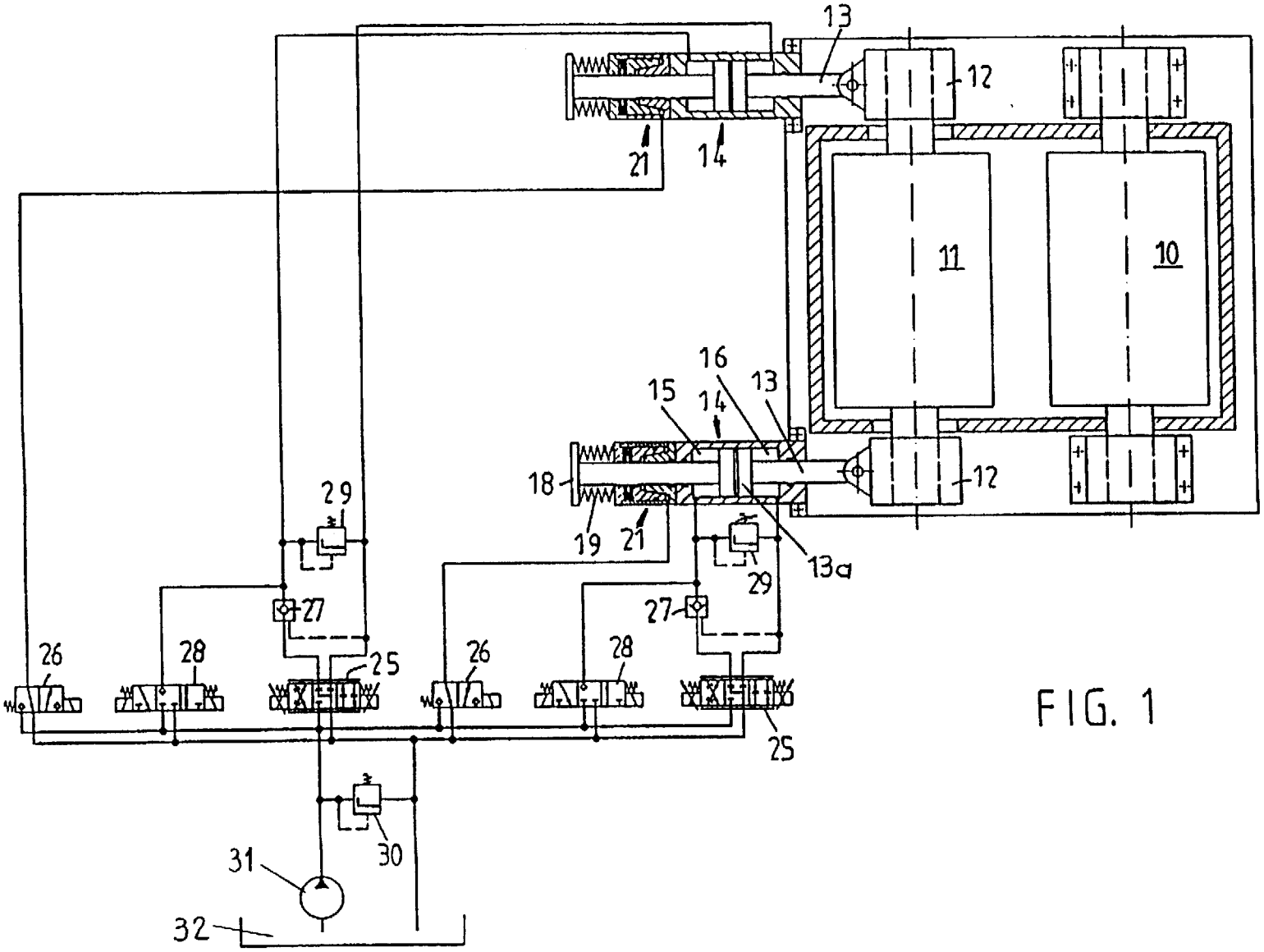
FIG. 1 is a schematic top plan view of a two-roll crusher and a hydraulic circuit for controlling the motion of the shiftable roll according to the invention.
Figure 2:
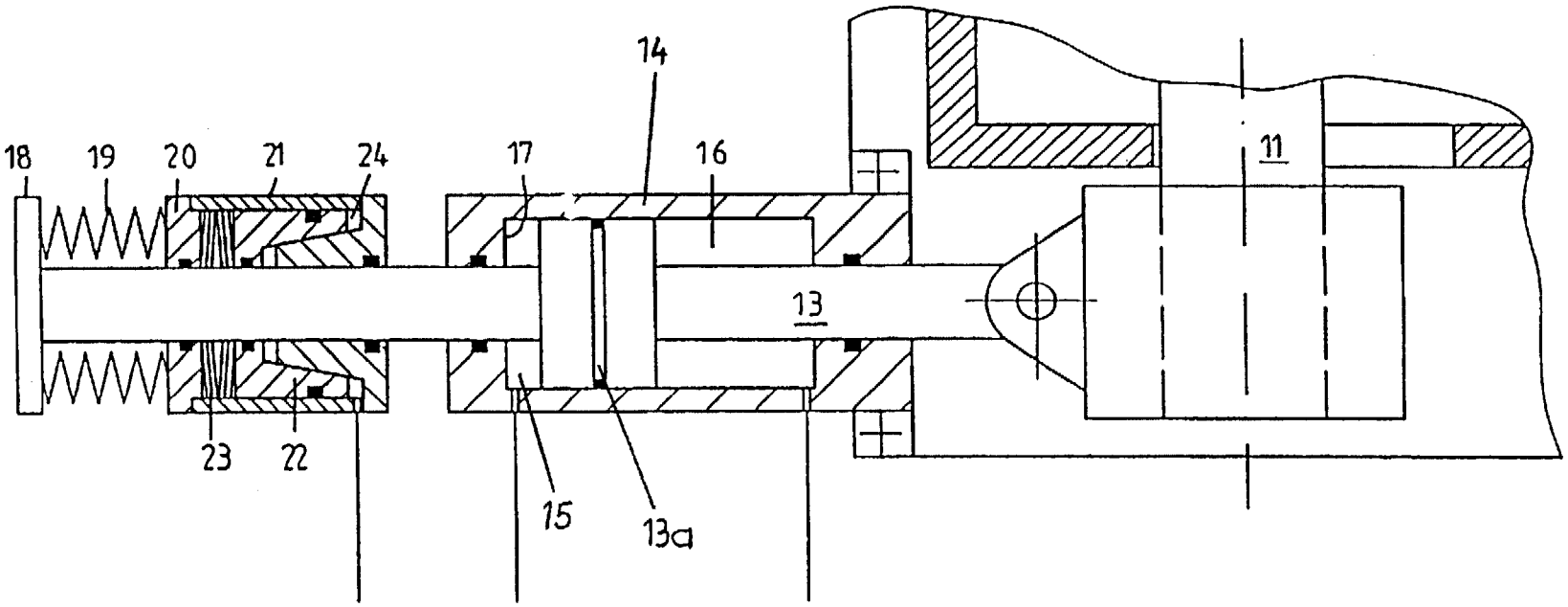
FIG. 2 is a top plan view, on an enlarged scale, of a detail of the structure shown in FIG. 1.

The two-roll crusher illustrated in FIG. 1 has a fixed roll 10 which is stationarily supported for rotation. Opposite ends of a shiftable roll 11 are held in respective bearing housings 12 coupled to piston rods 13 by means of which the shiftable roll 11 is radially displaceable relative to the fixed roll (countermember) 10. Each piston rod 13 is part of identically structured respective double-acting cylinders 14, each having two cylinder chambers (work chambers) 15 and 16 which are separated from one another by a slidable piston 13*a* affixed to the piston rod 13 and which may be selectively charged with a hydraulic fluid. The resulting pressure in the opposite work chambers varies the axial position of the piston rod 13. As shown in FIG. 2, the piston rod 13 is passed through the bottom 17 of the associated double acting hydraulic cylinder 14 and has, at its free end, a head 18 which is connected to the bottom 20 of a clamping head 21 with the intermediary of a spring 19. The clamping head 21 has a setting piston 22 which is movable against the force of a spring 23 situated between the setting piston 22 and the bottom 20 of the clamping head 21. When in the relaxed, expanded state, the spring 23 locks the piston rod 13 to the clamping head 21 by a wedging effect, whereas in an axially compressed state the spring 23 is released from the piston rod 13, so that the latter is shiftable relative to the clamping head 21.

The cylinder chambers 15 and 16 as well as a clamping head chamber 24 may be charged with hydraulic fluid.

Since the two piston rods 13 operate in synchronism and are of identical construction, the mode of operation and construction of the hydraulic circuit will be discussed below in conjunction with a single piston rod 13 and the clamping head 21 belonging thereto.

The position of the piston rod 13 may be set by pressurizing the work chambers 15 and 16 by means of a valve 25 which establishes a hydraulic connection between a pump 31 which draws hydraulic fluid from a sump 32, and the work chambers 15, 16. Before such an operation is effected, a valve 26 is actuated which pressurizes the work chamber 24 of the clamping head 21, whereby the clamping head 21 is released from the piston rod 13 by compressing the spring 23. When the desired position of the piston rod 13 is reached, the work chamber 24 of the clamping head 21 is depressurized, whereby the spring 23 again expands and thus locks the piston rod 13 to the clamping head 21 which lies against the outer radial face of the cylinder 14 corresponding to the position illustrated in FIG. 1.

A check valve 27 ensures that an oil leakage-free closing of the cylinder chamber 15 is effected which is prepressurized via a valve 28. The pressure is limited to a maximum magnitude by a pressure limiting valve 29. If the crushing forces exceed the set maximum pressure, hydraulic fluid flows from the work chamber 15 through the pressure limiting valve 29 into the work chamber 16, and, as a result, the piston rod 13 is withdrawn into the cylinder 14, that is, the piston rod 13 assumes its position approximately as shown in FIG. 2. In such a position the shiftable roll 11 has greater clearance from the stationary roll 10 than the set crushing gap. The clamping head 21 remains firmly in its position relative to the piston rod 13 and thus has moved away from the radial outer face of the cylinder 14. To reset the desired clearance (crushing gap), the valve 25 is actuated, whereby the pressure increases in the work chamber 15 of the cylinder 14 until the piston rod 13 has reached its position shown in FIG. 1 in which the clamping head 21 again abuts the outer radial face of the cylinder 14. During renewed actuation the clamping head 21 remains in its closed (locking) state. The settable pressure in the cylinder chamber 15 may be regulated in a stepless manner by a valve 30.

The synchronous control of the two cylinders 14 and the two piston rods 13 is effected in a conventional manner. Additionally, in the cylinder chamber 15 the pressure may be monitored by means of a sensor. If required, the cylinder chamber 15 may be coupled with a non-illustrated accumulator which has an adjustable biasing pressure for limiting the maximum crushing force.

It will be understood that the above description of the present invention is susceptible to various modifications, changes and adaptations, and the same are intended to be comprehended within the meaning and range of equivalents of the appended claims.

What is claimed is:

1. A roll crusher comprising (a) a crusher roll;

(b) support means for rotatably and radially shiftably supporting said crusher roll;

(c) a stationarily supported countermember cooperating with said crusher roll to define a crushing gap therewith;

(d) a hydraulic setting system for radially displacing said crusher roll for varying said crushing gap; said hydraulic setting system including a pressure source and a piston rod executing strokes and having an end coupled to said support means for transmitting to said crusher roll setting forces derived from said pressure source; and (e) an abutment means for limiting the strokes of said piston rod to set a minimum magnitude of said crushing gap; said abutment means including actuating means for placing said abutment means into a stroke-limiting state and into a piston rod-releasing state.

2. The roll crusher as defined in claim 1, wherein said abutment means comprises a clamping head mounted on said piston rod; and further wherein said actuating means comprises (a) a clamping mechanism contained in said clamping head; said clamping mechanism having a clamping position in which said clamping head is clamped to said piston rod and a releasing position in which said clamping head is slidable on said piston rod relative thereto; and (b) operating means for placing said clamping mechanism into one of said positions thereof.

3. The roll crusher as defined in claim 2, wherein said hydraulic setting system comprises a pressure limiting valve for limiting a maximum pressure exerted on said piston rod when said clamping mechanism is in said clamping position.

4. The roll crusher as defined in claim 2, wherein said clamping mechanism comprises a spring contained in said clamping head and surrounding said piston rod; said spring having a relaxed state in which said spring clamps said piston rod against said clamping head and a compressed state in which said spring releases said piston rod from said clamping head; said operating means comprising a setting piston slidably accommodated in said clamping head and energizing means for shifting said setting piston to place said spring into one of said states thereof.

5. The roll crusher as defined in claim 4, wherein said operating means further comprises a work chamber defined in said clamping head and bordered by said setting piston and hydraulic means for pressurizing said work chamber.

6. The roll crusher as defined in claim 5, wherein said hydraulic means forms part of said hydraulic setting system.

7. The roll crusher as defined in claim 2, wherein said hydraulic setting system further includes a stationarily supported cylinder having an inner space; said piston rod passing through said cylinder and carrying a piston dividing said inner space into first and second work chambers and valve means for establishing hydraulic communication between said pressure source and said first and second work chambers for displacing said piston rod; said clamping head being situated on said piston rod externally of said cylinder and preventing movement of said piston rod in a crushing gap-reducing direction when said clamping mechanism is in said clamping position and said clamping head is in an abutting relationship with said cylinder.

8. The roll crusher as defined in claim 7, wherein said piston rod passes through said clamping head; further comprising a piston rod head secured to said piston rod at an end thereof externally of said clamping head; said piston rod head being countersupported on said clamping head.

9. The roll crusher as defined in claim 8, further comprising a compression spring interposed between and being in contact with said piston rod head and said clamping head.

10. The roller crusher as defined in claim 1, wherein said abutment means includes means for allowing said crushing gap to be increased from said set minimum magnitude when said abutment means is in said stroke-limiting state.

* * * * *